US007169092B2

(12) United States Patent
Panatta

(10) Patent No.: US 7,169,092 B2
(45) Date of Patent: Jan. 30, 2007

(54) GYMNASTIC APPARATUS

(75) Inventor: Rodolfo Panatta, Apiro (IT)

(73) Assignee: Panatta Sport S.R.L., Apiro (IT)

( * ) Notice: Subject to any disclaimer, the term of this patent is extended or adjusted under 35 U.S.C. 154(b) by 564 days.

(21) Appl. No.: 10/457,880

(22) Filed: Jun. 10, 2003

(65) Prior Publication Data

US 2003/0232702 A1 Dec. 18, 2003

(30) Foreign Application Priority Data

Jun. 12, 2002 (IT) ..... BO2002A0371

(51) Int. Cl.
*A63B 21/062* (2006.01)
*A63B 21/00* (2006.01)

(52) U.S. Cl. ..... 482/99; 482/135

(58) Field of Classification Search ..... 482/99–103, 482/137–138, 79–80, 139, 908
See application file for complete search history.

(56) References Cited

U.S. PATENT DOCUMENTS 4,491,314 A * 1/1985 Belyavsky et al. ..... 482/42
4,711,448 A * 12/1987 Minkow et al. ..... 482/100
4,957,281 A * 9/1990 Christolear, Jr. ..... 482/100
5,062,633 A * 11/1991 Engel et al. ..... 482/118
5,413,517 A * 5/1995 Kamijima ..... 446/354
5,749,668 A * 5/1998 McIlvain et al. ..... 482/79
6,267,709 B1 * 7/2001 Jacques et al. ..... 482/8

OTHER PUBLICATIONS

Henry T. Brown, 507 Mechanical Movements, 1901, Brown & Seward. pp. 12-15.*

* cited by examiner

*Primary Examiner*—Jerome Donnelly
*Assistant Examiner*—Fenn C. Mathew
(74) *Attorney, Agent, or Firm*—Armstrong, Kratz, Quintos, Hanson & Brooks, LLP

(57) ABSTRACT

In a gymnastic apparatus, the actuator (22) is fitted in fixed angular position to a first shaft (16) to oscillate from initial to final position, normally maintained in initial position by a weight unit (8) and connected to the weight unit (8) by a driving device (33) provided with a cam (38) splined on a second shaft (34) transversal to the first shaft (16), two gears (37) are joined in angular position to the first and second shaft (16, 34), respectively.

6 Claims, 3 Drawing Sheets

GYMNASTIC APPARATUS

The present invention refers to a gymnastic apparatus.

In particular, the present invention refers to a gymnastic apparatus used to train anterior thigh muscles, commonly defined as "leg extension apparatus"; the following description continues with reference to the aforementioned term, without losing its general character.

In the field of gymnastic apparatuses, a leg extension apparatus comprises a user-operated actuator composed of a shaft fitted to oscillate around its basically horizontal longitudinal axis, a support arm that extends transversally to the shaft and fitted to the shaft in fixed angular position during use and a padded roll that projects from the support arm parallel to the shaft and oscillates around the aforementioned axis from initial to final position.

A leg extension apparatus also comprises a weight unit used to normally maintain the actuator and the padded roll in initial position; and driving means used to connect the actuator and weight unit, comprising at least one cam fitted to the shaft in coaxial position to the axis and connected to the weight unit by means of at least one traction cable.

Since the cam is fitted to the actuator shaft in coaxial position, the cam and traction cable are placed in user-accessible positions. For this reason, the leg extension apparatus of known type as illustrated above has relatively reduced ergonomics and high volumes.

The purpose of the present invention is to obtain a gymnastic apparatus without the aforementioned drawbacks.

The gymnastic apparatus of the present invention comprises an actuator provided with at least a first shaft with first determined longitudinal axis and at least a user-operated actuator fitted to the first shaft in fixed angular position during use to oscillate around the first axis from initial to final position; a weight unit used to normally maintain the actuator in initial position; and driving means used to connect the actuator and weight unit, comprising at least a second shaft with second determined longitudinal shaft and at least a cam joined in angular position to the second shaft; characterised in that the first and second axis are transversal and characterised in that the driving means also comprise two gears joined to the first and second shaft in angular position.

The description of the invention continues with reference to the enclosed drawings of a non-restrictive embodiment, whereby:

Figure 1:
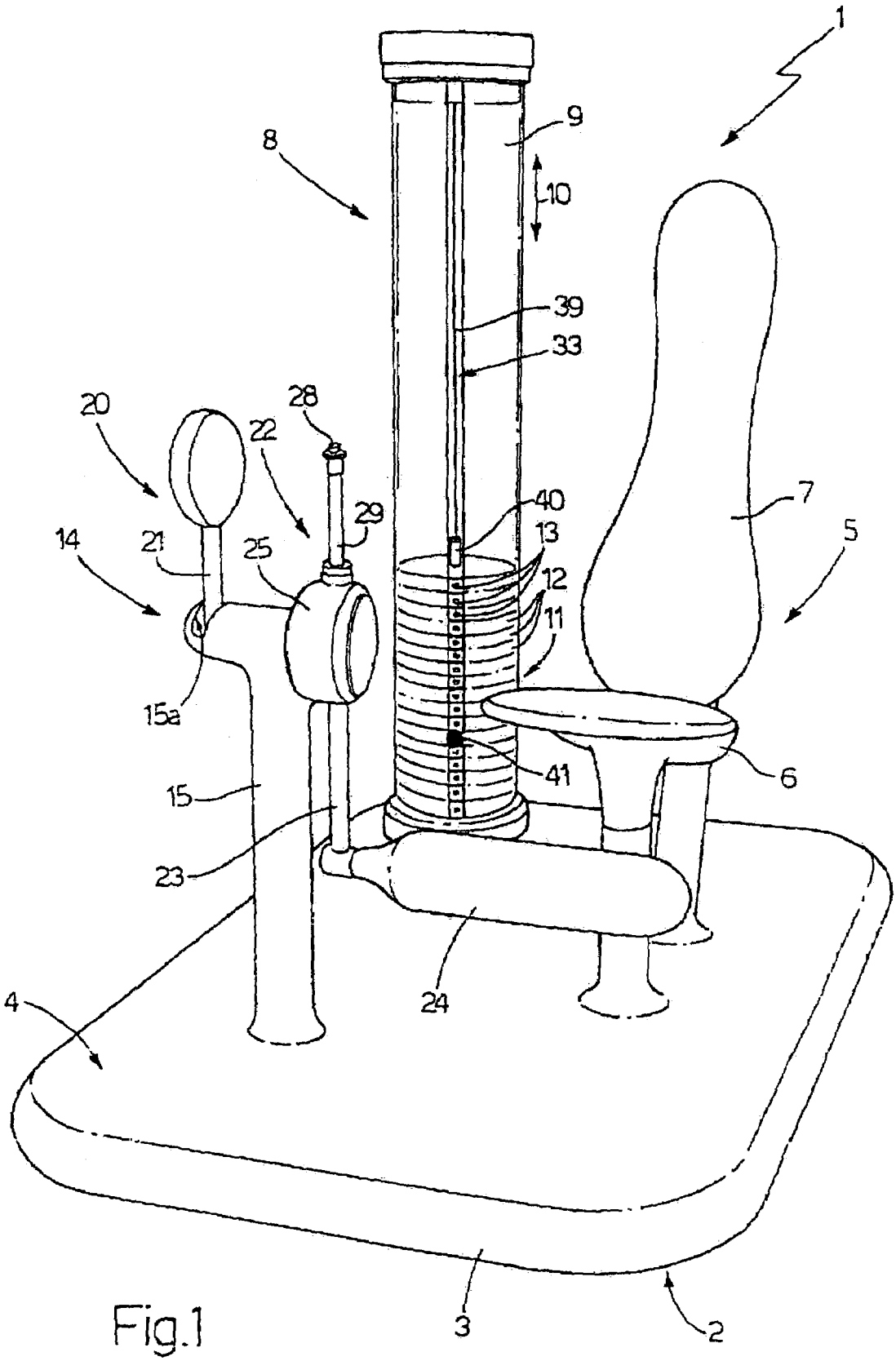
FIG. 1 is a diagrammatic perspective view of a preferred embodiment of the gymnastic apparatus of the invention.

With reference to FIG. 1, number 1 indicates a gymnastic apparatus for anterior thigh muscles, referred to in the following description as "leg extension apparatus".

The leg extension apparatus 1 is provided with a base 2, which is used to place the leg extension apparatus 1 on the ground, and comprises a box-shaped body 3 with basically parallelepiped shape and rounded corners, limited on top by a basically level horizontal surface 4.

The leg extension apparatus 1 also comprises a support device 5 for the user, provided with a seat 6 and a backrest 7 that extend upwards from surface 4; and a weight unit 8 comprising a tubular column 9, which extends upwards from surface 4 in a basically vertical direction 10 orthogonal to surface 4, with basically elliptical transversal cross-section, capable of housing a stack 11 of basically elliptical plates 12, placed one on top of the other in direction 10, matched to the column 9 and provided with a hole 13 through the plate 12 transversally to direction 10.

Figure 2:
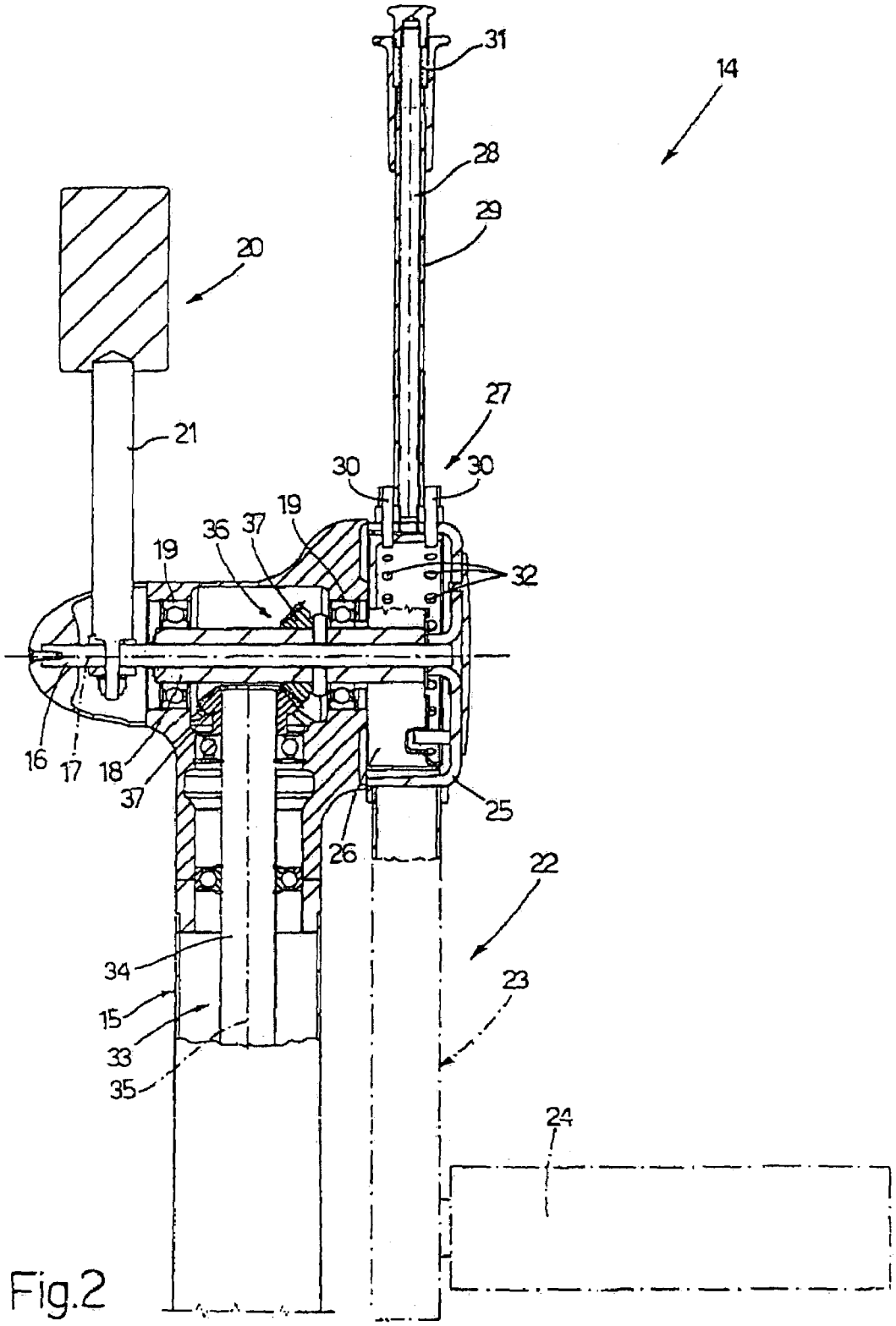
FIG. 2 is a diagrammatic side view, with cross-sectioned parts and removed parts, of a detail of FIG. 1.

With reference to FIGS. 1 and 2, the weight unit 8 is actuated by the user by means of an actuator device 14 comprising a support tubular column 15 that extends upwards form surface 4 in direction 10; and a shaft 16 with a basically horizontal longitudinal axis 17 parallel to surface 4 that engages in fixed angular axial position a metal tube 18 coaxial to axis 17 and is fitted to column 15 by means of two bearings 19 located between the metal tube 18 and the column 15.

The device 14 also comprise a counterweight 20 of known type, provided with a support arm 21, which projects in radial position outwards from axis 17, engages a slot 15*a* through the column 15 and is splined to the shaft 16 to oscillate around the axis 17; and a user-operated actuator 22.

The actuator 22 comprises a support arm 23 provided with a padded roll 24 that projects from the arm 23 parallel to axis 17 and projects in radial position outwards from a central hub 25, extending around a cylindrical bushing 26 fitted to the metal tube 18 in coaxial position to axis 17, fitted to bushing 26 with possibility of rotation and axial movement and blocked in angular position on the bushing 26 by means of a hooking device 27 that allows for adjusting the initial lowered position of the actuator 22 around the axis 17 (FIG. 1).

The device 27 comprises a cylindrical rod 28 that projects in radial position outwards from the bushing 26 and a metal tube 29, which is fitted onto the rod 28, has two hooking pins 30 projecting from the metal tube 29 at the free lower end and is normally maintained in lowered hooking position by a spring 31 located between the rod 28 and the metal tube 29, in which each pin 30 engages a hole 32 of a series of multiple holes 32 located in radial position through the bushing 26 and uniformly distributed around the axis 17.

The shaft 16 and the actuator 22 are connected to the weight unit 8 by means of a driving device 33 comprising a shaft 34 with longitudinal axis 35 parallel to direction 10 and perpendicular to axis 17 that extends through the base 2 and inside the column 15 and is fitted to the shaft 16 through a gear 36 defined by two toothed conical wheels splined to the shaft 16 and the shaft 34, respectively.

Figure 3:
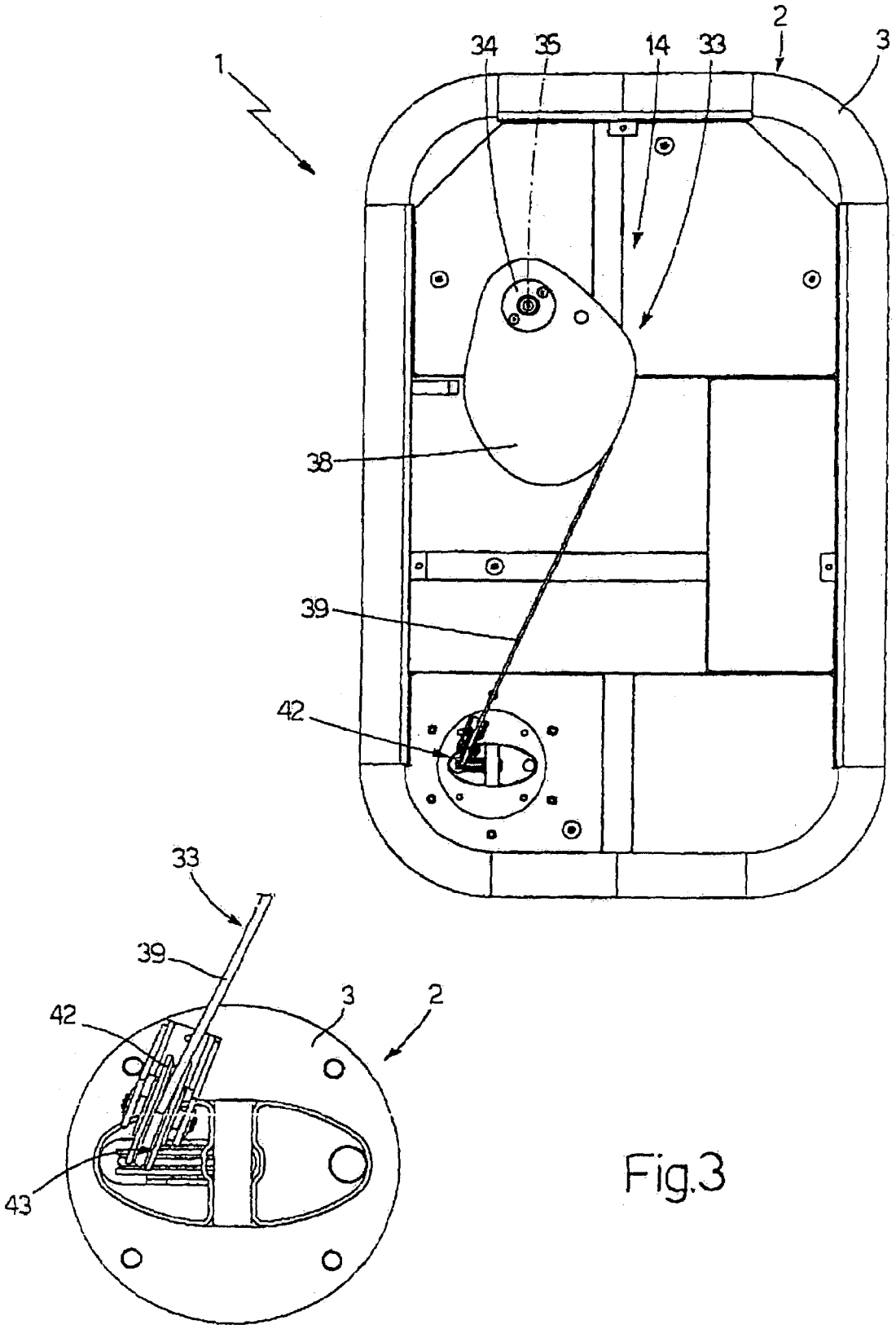
FIG. 3 is a diagrammatic bottom view, with enlarged parts and removed parts, of the gymnastic apparatus of FIG. 1.

With reference to FIG. 3, the device 33 comprises at least a cam 38 splined on the lower free end of the shaft 34, housed inside the box-shaped body 3 and connected by means of at least one traction cable 39 of known type to a rod 40, which is part of the an actuator device 14, fitted to the plates 12, and axially blocked to one of the plates 12 by means of a locking pin 41.

With reference to the above, it must be noted that the cable 39 is wound around multiple pulleys 42, with one of the pulleys housed inside the box-shaped body 3 and provided with a guide groove 43 engaged by the cable 39, having a width higher than the thickness of the cable 39 in order for the cable 39 to be directed inside the groove 43 according to the angular position of the cam 38 around the axis 35.

The user is seated on the support device 5, that is to say the seat 6 and backrest 7, and actuates the hooking device 27 and the actuator 22 to select the initial lowered position of the actuator 22 around the axis 17. The user moves the metal tube 29 against the action of the spring 31 to a raised release position, in which the pins 30 disengage from the holes 32; then moves the assembly composed of the actuator 22 and the hooking device 27 around the axis 17; and finally releases the metal tube 29 to bring the pins 30 back to lowered hooked positions under the action of the spring 31.

Then the user engages the padded roll 24 with his/her legs to move the actuator 22 to the final raised position (not shown) against the action of the plates 12 of the weight unit 8.

The invention claimed is:

1. Gymnastic apparatus comprising an actuator device (14) provided with at least a first shaft (16) with first determined horizontal axis (17) and at least a user-operated actuator (22) fitted to the first shaft (16) in fixed angular position during use to oscillate around the first axis (17) from an initial to a final position; a weight unit (8) used to normally maintain the actuator (22) in the initial position and a driving means (33) used to connect the actuator device (14) and weight unit (8), comprising at least a second shaft (34) with a second determined vertical axis (35) and at least a cam (38) joined in angular position to the second shaft (34); characterised in that said cam (38) is splined to a base of the second shaft (34); with the driving means (33) comprising two gears (37) joined to the first and second shaft (16, 34), respectively.

2. Gymnastic apparatus as defined in claim 1, in which each gear (37) consists of a conical wheel.

3. Gymnastic apparatus as defined in claim 1, in which the actuator (22) is rotatably fitted the first shaft (16); with a hooking element (27) being provided to block the actuator (22) to the first shaft (16) in angular position in order to selectively control the initial position.

4. Gymnastic apparatus as defined in claim 3, in which the hooking element (27) comprises at least multiple holes (32) formed in a radial position through a bushing (26) arranged around the first axis (17); at least a pin (30) joined to the actuator (22) in angular position and moved from a hooking position, in which the pin (30) engages one of the holes (32), to a release position, an elastic thrust means (31) acting on the pin (30) to bias the pin (30) to hooking position; and an actuator means (29) to move the pin (30) to the release position against the action of the elastic thrust means (31).

5. Gymnastic apparatus as defined in claim 4, in which the actuator means (29) consist of a metal tube (29) that extends in a radial position to the first axis (17) and is joined to the pin (30).

6. Gymnastic apparatus as defined in claim 1, in which the gymnastic apparatus is a leg extension apparatus.

* * * * *